United States Patent [19]

Andersson

[11] Patent Number: 4,801,026

[45] Date of Patent: Jan. 31, 1989

[54] DEVICE IN A STORAGE RACK

[75] Inventor: Olof I. Andersson, Säffle, Sweden

[73] Assignee: Electrolux Constructor Aktiebolag, Sweden

[21] Appl. No.: 547,388

[22] Filed: Oct. 31, 1983

[30] Foreign Application Priority Data

Nov. 22, 1982 [SE] Sweden ..... 8206647

[51] Int. Cl.[4] ..... A47F 5/00

[52] U.S. Cl. ..... 211/183; 211/191

[58] Field of Search ..... 211/183, 191, 192, 198, 211/200; 108/56.3, 111; 29/155 R

[56] References Cited

U.S. PATENT DOCUMENTS

| | | | |
|---|---|---|---|
| 1,792,489 | 2/1931 | Gilmore | 29/155 R |
| 2,087,626 | 7/1937 | Minshall | 29/155 R |
| 2,308,565 | 1/1943 | Mitchell | 29/155 R |
| 2,604,213 | 7/1952 | Bales et al. | 211/183 |
| 2,918,176 | 12/1959 | Bell et al. | 211/191 |
| 3,102,641 | 9/1963 | Konstant et al. | 211/191 |
| 3,154,833 | 11/1964 | Kimball | 211/186 |
| 3,475,044 | 10/1969 | Konstant | 211/192 X |
| 3,647,080 | 3/1972 | Denny | 211/191 |

FOREIGN PATENT DOCUMENTS

| | | | |
|---|---|---|---|
| 945113 | 12/1963 | United Kingdom | 211/192 |

*Primary Examiner*—Blair M. Johnson

*Attorney, Agent, or Firm*—Alfred Miller

[57] ABSTRACT

This invention relates to a device in a storage rack, for instance a pallet rack. The device comprises upright columns and stays interconnecting the columns. The columns have mainly a C-shaped profile with a centrally disposed bent part to take up the forces, whereas the stays each comprise an elongated tube having L-shaped end parts being connected to the said bent part.

5 Claims, 2 Drawing Sheets

DEVICE IN A STORAGE RACK

This invention relates to a device in a storage rack, for instance a pallet rack comprising columns and stays interconnecting the columns.

Conventional pallet racks usually comprise columns of cold-rolled sheet steel, each have a C-shaped profile and provided with several holes to take up horizontal beams on which the goods are placed. Together with such columns diagonal stays are used which, by means of screw joints, are fastened to the middle of the waist or intermediate part of the columns, or in separate welded sheet-steel plates between the flanges of the beams. The first alternative has the drawback that both the screw joints and the fastening means for the horizontal beams should be accomodated in the space in the waist of the columns so that the screw joints will, to some extent, prevent the beams from being positioned in the intended place unless the distance between the holes for the beams is made larger than desirable. The latter alternative has the drawback that the manufacture becomes complicated since a welding operation has to be done, which involves the risk of weak connections in the areas which are directly exposed to the forces transferred from the stays to the columns. In a conventional embodiment the stays comprise cylindrical tubes having flattened and bent ends. As a rule, such stays work satisfactorily in conventional, stationary pallet racks, but in the type of pallet racks which comprise mobile units, i.e. when the pallet racks are placed on carriages which can be moved towards and from one another to form passageways between the racks, constant vibrations occur which successively can result in exhaustion of the bent flattened part of the stays. The object of this invention is to eliminate these drawbacks and to provide a connection between column and stay in which the forces from the stays, in order to avoid turning of the column when loaded, are transferred to the middle of the column through its shear center at the same time as the stays are so made that they will resist the forces and vibrations to which they are exposed, and will allow two stays to be fastened to the column at the same point of connection.

The object is achieved in a device according to the invention having the characteristic features defined in the claims annexed hereto.

Figure 1:
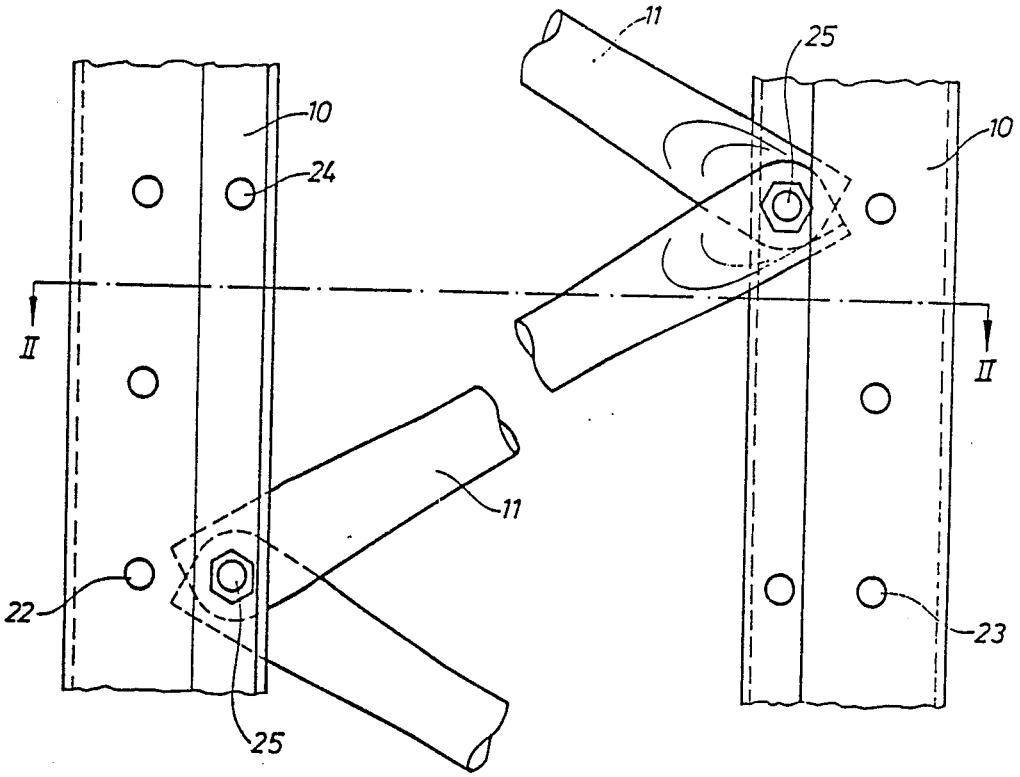
Figure 2:
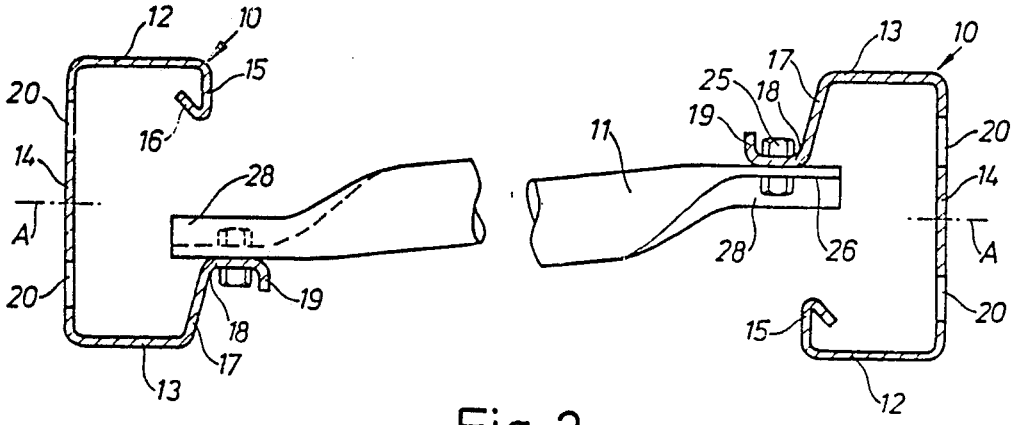
Figure 3:
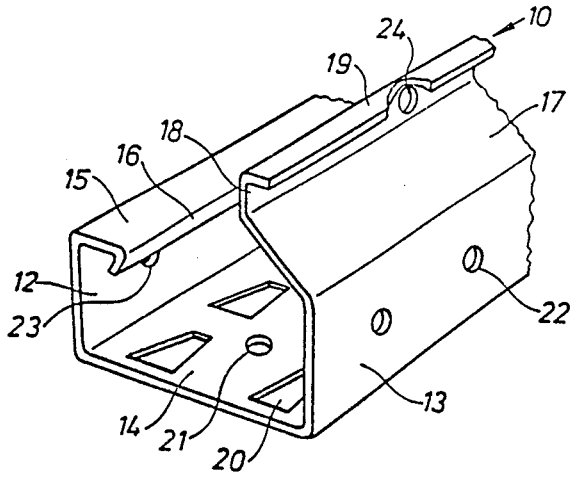
Figure 4:
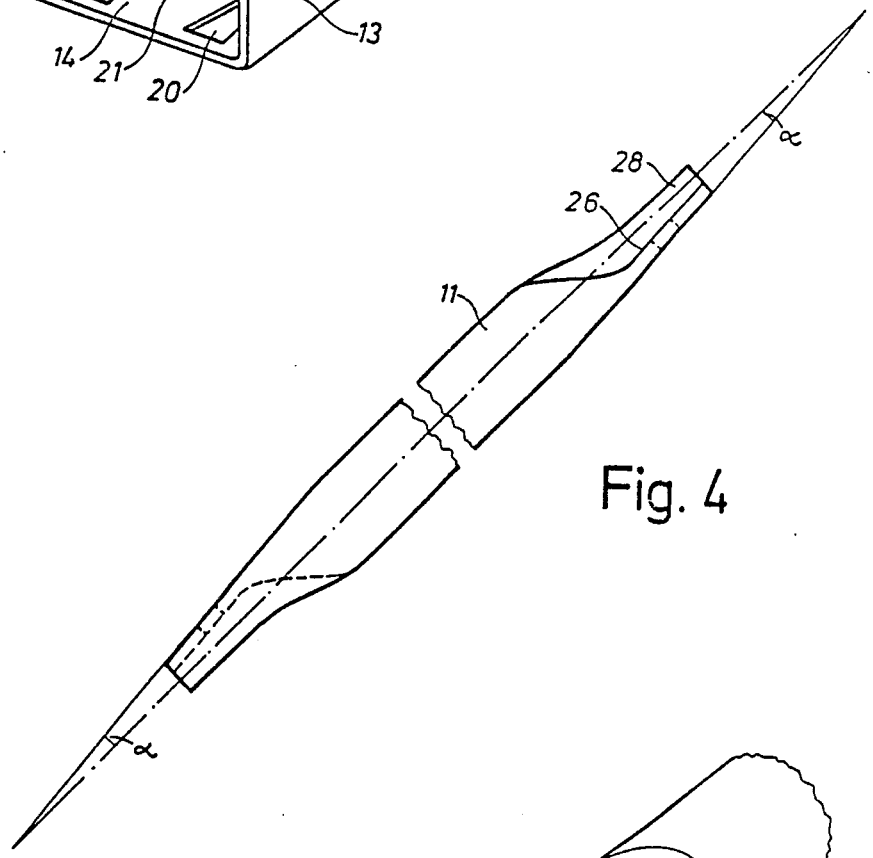
Figure 5:
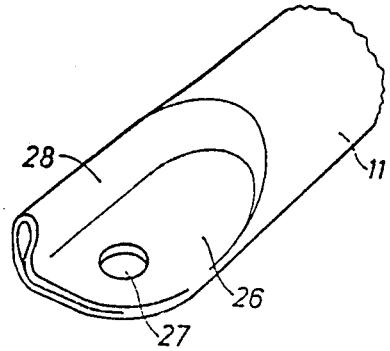

An embodiment of the invention will now be described with reference to the accompanying drawings in which FIG. 1 in a vertical view shows two columns with interposed stays, FIG. 2 is a section on the line II—II of FIG. 1, FIG. 3 is a perspective view of a column, FIG. 4 is a side elevation view of a stay and FIG. 5 is a perspective view of one end of the stay.

As appears from the Figures, the pallet rack comprises columns 10 which are interconnected by means of stays 11. The column 10 is a C-shaped cold-rolled sheet steel having flanges 12 and 13, and a waist 14. The folded outer end 15 of one of the flanges 12 is provided with a reinforcement consisting of an inwardly bent portion 16 whereas the other flange 13 has a portion 17 which is retracted towards an imagined middle plane A of the column, and has a bent part 18 ending in a reinforcing flange 19.

The columns support several horizontal beams (not shown), which, for instance, carry pallets for goods. In order to fasten the beams, the waist 14 of the column is provided with two lines of downwardly converging holes 20 in which hooks of the beams are inserted and locked. In the waist 14 between the holes 20 there are further holes 21 for pins intended to lock the beams to the columns.

In the flanges 12 and 13 there are also several holes 22 and 23, respectively, which, under certain conditions, are used for fastening accessories.

The stay 11, which is fastened to holes 24 in the bent part 18 by means of a screw joint 25 comprises a tube with partly flattened end parts 26 with through holes 27, one end of the tube having a reinforcement 28. This reinforcement stiffens the end part and prevents bending about an axis parallel to the plane of the flattened part and allows fastening of another stay in the connecting point.

The flattened part is in a plane which is inclined an angle $\alpha$ relative to the central axis of the tube, the angle $\alpha$ being in the range of 5°–15°.

The ends of the stay are so designed that the flat part at one end is turned through 180° relative to the flat part at the other end. This means that the flat part will rest against the bent part 18 in both columns when these columns are placed with their waists oppositely directly and with their holes 20 converging downwards.

I claim:

1. A rack of the type used for storing pallets comprising at least two substantially vertical disposed and spaced columns, a plurality of stays interconnecting said columns at end parts thereof, each of said columns being substantially C-shaped and being provided with at least one flange extending substantially parallel to the longitudinal axis of said column, each of said flanges on said spaced columns being bent inwardly in opposite directions toward an imaginary middle plane of the respective column and continuing in an outwardly bent part forming a flat abutment surface, and means on each of said outwardly bent parts by which said end parts of said stays can be fastened thereto, and each of said stays being a tube whose outer ends are partly flattened to form an L-shaped profile facing in opposite directions and having means by which the stay can be fastened to said abutment surfaces of said outwardly bent parts of the flanges of each of said columns.

2. A rack as claimed in claim 1 further comprising a second flange on said column and being spaced from said one flange, said second flange being provided with an inturned reinforcement part.

3. A rack as claimed in claim 1 wherein said outwardly bent part is further provided with an extreme end portion which is bent away from said flat abutment surface to form a reinforcing flange.

4. A rack as claimed in claim 1 wherein said outer ends of said tube are partly flattened and each form an L-shaped profile which are turned through 180 degrees relative to each other.

5. A rack as claimed in claim 1 wherein said flat abutment surface of the outwardly bent part is at an angle of between 5 to 15 degrees to the longitudinal axis of said tube.

* * * * *

UNITED STATES PATENT AND TRADEMARK OFFICE

CERTIFICATE OF CORRECTION

PATENT NO. : 4,801,026

DATED : January 31, 1989

INVENTOR(S) : Olof I. Andersson

It is certified that error appears in the above-identified patent and that said Letters Patent is hereby corrected as shown below:

Column 2, line 29, delete "directly" and insert --directed--;

Column 2, line 33, delete "vertical" and insert --vertically--.

Signed and Sealed this

Seventeenth Day of October, 1989

*Attest:*

*Attesting Officer*

DONALD J. QUIGG

*Commissioner of Patents and Trademarks*